United States Patent [19]

Killion et al.

[11] Patent Number: 4,953,518

[45] Date of Patent: Sep. 4, 1990

[54] EXHAUST GAS RECIRCULATION VALVE

[75] Inventors: Robert F. Killion, Florissant; Michael J. Wolfe, Villa Ridge, both of Mo.

[73] Assignee: Tomco Incorporated, St. Louis, Mo.

[21] Appl. No.: 339,193

[22] Filed: Apr. 14, 1989

[51] Int. Cl.[5] ..... F02M 25/07

[52] U.S. Cl. ..... 123/568

[58] Field of Search ..... 123/568, 569; 251/61, 251/61.1

[56] References Cited

U.S. PATENT DOCUMENTS

| | | | |
|---|---|---|---|
| 3,800,765 | 4/1974 | Thompson | 123/568 |
| 4,180,034 | 12/1979 | Vogelsberg | 123/568 |
| 4,186,703 | 2/1980 | Haka et al. | 123/568 |
| 4,364,368 | 12/1982 | Blanchette | 123/568 |
| 4,399,798 | 8/1983 | Stoltman | 123/568 X |
| 4,492,210 | 1/1985 | Hunt | 123/568 |

*Primary Examiner*—Willis R. Wolfe

*Attorney, Agent, or Firm*—Polster, Polster and Lucchesi

[57] ABSTRACT

An exhaust gas recirculation (EGR) valve for controlling the amount of exhaust entering the intake manifold of an internal combustion engine. The EGR valve comprises a universal base so that a single base may fit many makes and models of vehicles, a diaphragm valve having two ports facing opposite directions protruding from the top of said valve, making connection of a vacuum hose to the EGR valve easier, and a back pressure transducer wherein the transducer has means to alter the vacuum required to close the valve.

8 Claims, 3 Drawing Sheets

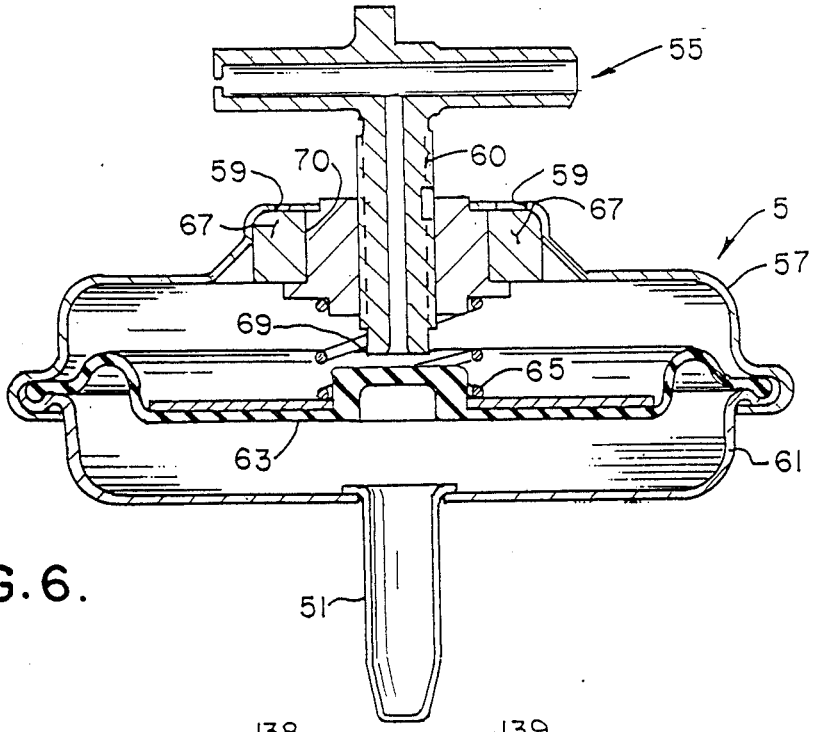
FIG. 6.
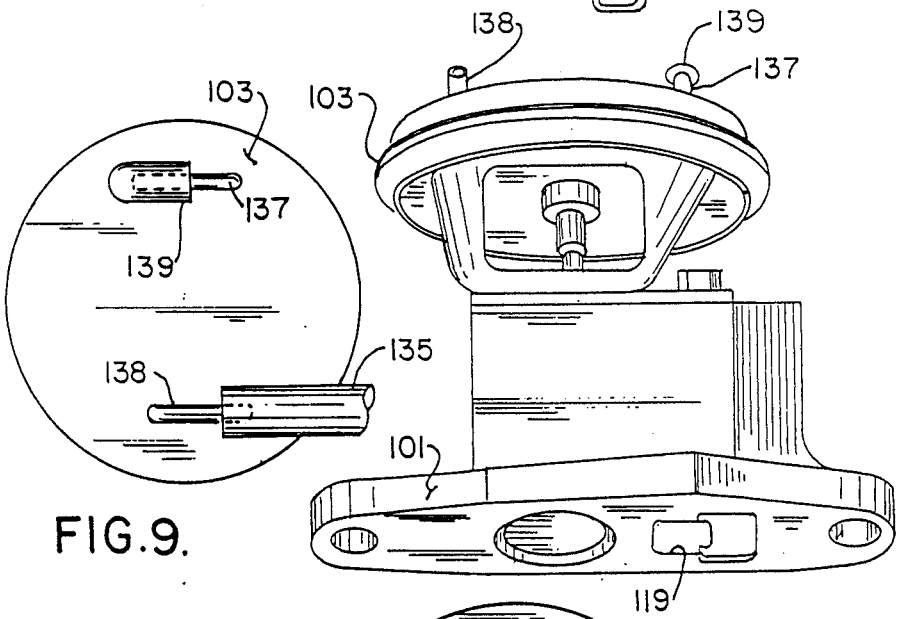
FIG. 7.
FIG. 9.
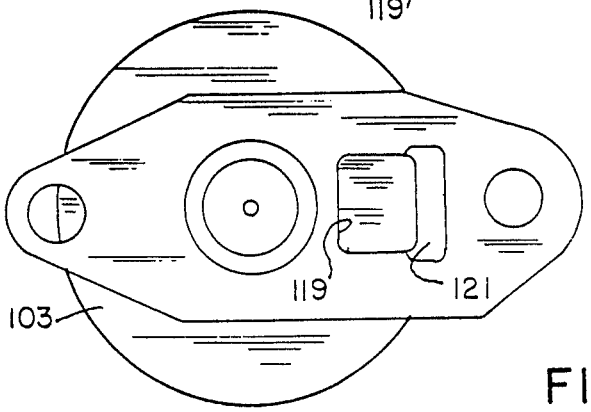
FIG. 8.

EXHAUST GAS RECIRCULATION VALVE

BACKGROUND OF THE INVENTION

This invention relates to exhaust gas recirculation (EGR) valves for the internal combustion engines of vehicles such as automobiles, vans, and trucks, and in particular to a universal EGR valve which is easy to install, is easily connected to the vacuum tube, and is easily calibrated.

A major part of anti-pollution devices on the internal combustion engines of present day vehicles is the exhaust gas recirculation valve. EGR valves are attached to the exhaust manifold where the crossover pipe leads to the intake manifold. At that point, the valve is inserted into the exhaust manifold through a pre-existing hole to regulate the amount of exhaust entering the intake manifold. This cools the peak combustion temperature, provides a better burn of the gas and reduces $NO_x$ emissions.

There are presently two types of EGR valves, ported vacuum EGR valves and back pressure EGR valves. In the former, a tube connects the valve to the carburetor, harnessing the vacuum created by the carburetor. When the vacuum becomes strong enough, the vacuum opens the valve and allows the exhaust gas to flow freely from the crossover pipe to the intake manifold. There is no actual regulation of the flow of exhaust here.

In the latter, a back pressure transducer is interposed between the valve and the carburetor along the vacuum line. The transducer has an exhaust pressure tube which is inserted into the manifold to measure the pressure in the crossover pipe. The back pressure transducer regulates the amount of exhaust entering the intake manifold based on the pressure within the crossover pipe. When the back pressure transducer valve is opened, air is bled into the vacuum line. Thus, the EGR valve is by-passed until the pressure within the back pressure transducer reaches a specified point. When the set point is reached, the back pressure transducer valve is closed and the bypass is shut off. The vacuum then opens the EGR valve, allowing exhaust to pass to intake manifold. When the pressure drops below its set point, the bypass is again opened and the exhaust is prevented from entering the intake manifold Use of the back pressure transducer allows vehicles to reach stricter emission standards and increases fuel economy by creating an even better burn of the gas.

The problems associated with EGR valves are problems of compatibility, installation, and clogging.

Presently major car manufacturers not only use different engines but alter their engines from time-to-time. Thus on different makes and models of vehicles, the holes for the EGR valves and the EGR valves themselves vary widely. This requires a mechanic to stock hundreds of different types of valves to be able to work on a wide variety of vehicles, placing a severe financial strain on service stations and mechanics. Presently, there are no EGR valves having a base which could fit a variety of styles, makes, and models of vehicles.

Mounting problems are due partially to the fact that the valve canister often extends out over the bolt holes in the base. This provides for little maneuverability and makes securing the base to the exhaust manifold very difficult.

Mounting is also complicated by the fact that the carburetor and exhaust manifold can be in varying locations under the hood, depending on the make and model of the vehicle. Attachment is further complicated by the fact that the port on the valve, to which the vacuum tube is attached, is fixed in one direction. Thus, the vacuum tube may have to be bent 180° to be attached to the valve. This problem was addressed by Hunt, U.S. Pat. No. 4,492,210. Hunt provides a back pressure EGR valve in which the valve and transducer are contained within a single canister. The canister rotates about its longitudinal axis to make connection to the vacuum hose easier The canister is mounted on a cylindrical fitting which is attached to the top of the base. The valve stem slides through the fitting and the fitting protrudes through a hole in the bottom of the canister. The canister is then held in position by means of a retaining ring. This allows the canister to rotate on the base. However, the canister has an internal spring which tends to pull the bottom of the canister away from the fitting and pulling it against the retaining ring. The force of the spring acting against the retaining ring eventually pulls the retaining ring off the fitting and the EGR valve and base must then be replaced.

The mounting problems associated with EGR valves such as Hunt's can be overcome by using a smaller canister. This can be accomplished by using an external back pressure transducer. However, there presently is no easily mounted EGR valve having remote or external back pressure transducer all connected to the same base. General Motors, in their repair kit, EGR R, supplies a remote back pressure transducer having an adapter plate which mounts to the manifold beneath the base of a ported EGR valve. This repair kit enables older model cars to meet new stringent emission standards. It may also be used as a substitute for back pressure transducers in single piece back pressure EGR valves, such as Hunt's, which have a clogged transducer. However, on GM's repair kit, the pressure tube which is attached to the adapter plate of the back pressure transducer is permanently secured and cannot rotate. This makes connection of the back pressure transducer to the EGR valve more difficult requiring more tubing between the pressure tube and the stem to make connection easier.

SUMMARY OF THE INVENTION

A principal object of the present invention is to provide a universal EGR valve, whose base may be used on many makes and models of vehicles so that a mechanic need only keep a few of such valves in stock rather than the several hundred that are presently required.

Another object of the present invention is to provide an EGR valve which is easily mounted on a vehicle engine.

Another object of the present invention is to provide an EGR valve having a remote back pressure transducer wherein the back pressure required to control the vacuum may be easily calibrated.

Another object of the present invention is to provide an EGR valve having means which make attachment of a vacuum hose to the valve easier, yet wherein the valve will not be subject to breakage due to vibration or to its internal workings.

Another object of the invention is to provide an EGR valve having an external back pressure transducer, wherein the transducer and the valve are attached to a single base.

Another object of the present invention is to provide a back pressure EGR valve wherein it is easy to check the back pressure.

These and other objects of the present invention will become obvious to those skilled in the art upon reviewing the following description in light of the accompanying drawings.

In accordance with the aspects of the present invention there is provided a universal base having a pathway through which exhaust gas flows. The pathway includes an entrance, which is blocked by a valve, an exit, and a hole through the base's side which communicates with the entrance. A pressure tube is rotatably mounted in this hole and is attached, at its other end, to a back pressure transducer. The ability of the tube to rotate aids in mounting the base to the manifold and in mounting the back pressure transducer into the vacuum line. The protruding pressure tube also allows for easy measuring of pressure within the exhaust.

The back pressure transducer comprises a "T" nozzle and an internal diaphragm. The nozzle has a threaded stem such that the distance between the bottom of the stem and the diaphragm may be altered. The change in distance alters the pressure required to create a vacuum in the EGR valve. Thus the back pressure transducer can be calibrated, allowing the same valve to be used on a variety of makes and models of vehicles.

One embodiment of the EGR valve is provided with two ports on the top of the valve so that the vacuum tube may be attached to the valve. The ports face opposite directions to ensure that the vacuum tube coming from the carburetor will not have to be bent more than 90° to be attached to the EGR valve. The hose is attached to the most convenient port. The other port is capped so that there will not be a leak in the vacuum line.

BRIEF DESCRIPTION OF THE DRAWINGS

FIG. 6 is a cross-sectional view of the transducer of the present invention.

FIG. 7 is a perspective view of a second embodiment of the present invention.

FIG. 8 is a bottom plan of the base of the embodiment of FIG. 7.

FIG. 9 is a top plan view of a vacuum motor portion of the embodiment of FIGS. 7 and 8, showing one port of the vacuum motor attached to a vacuum hose and a second port capped.

DESCRIPTION OF THE PREFERRED EMBODIMENT

Figure 1:
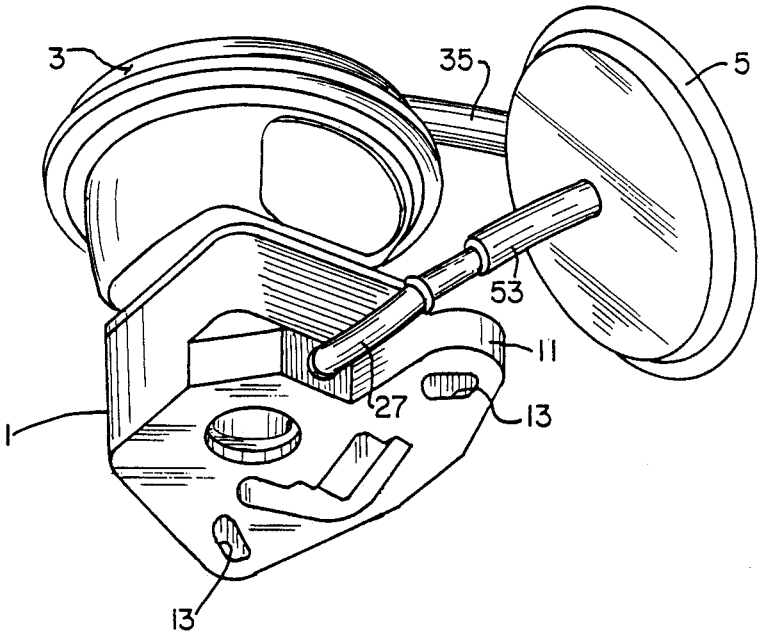
FIG. 1 is a perspective view of one embodiment of exhaust gas recirculation valve of the present invention.
Figure 2:
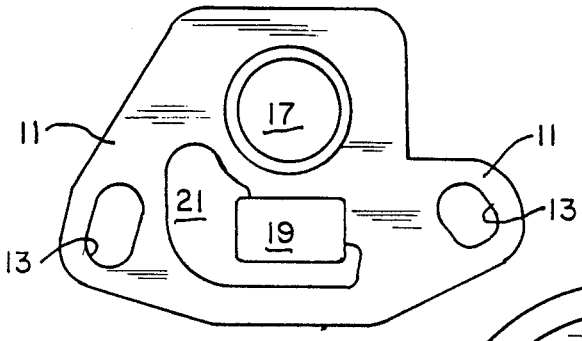
FIG. 2 is a bottom plan view of the base of the valve of FIG. 1.
Figure 3:
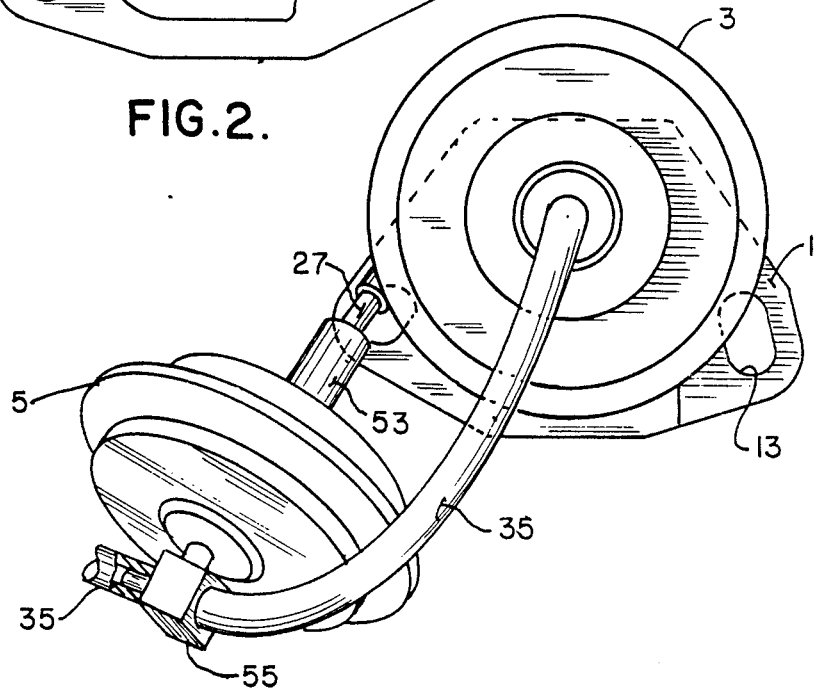
FIG. 3 is a top plan view of the valve of FIG. 1.
Figure 4:
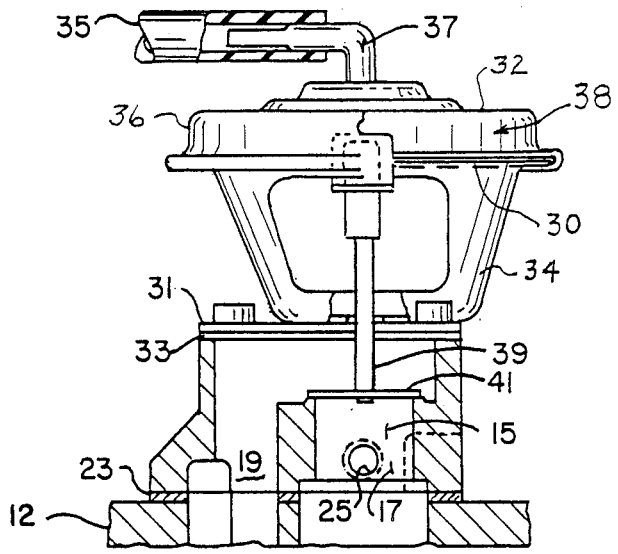
FIG. 4 is a view in side elevation of the valve of FIG. 1, partially in cross-section and partially broken away.
Figure 5A:
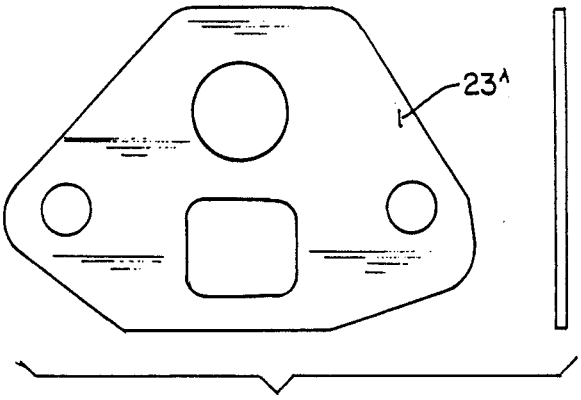
FIGS. 5A–5D are top plan views of model specific gaskets for use with the base of the present invention.
Figure 5B:
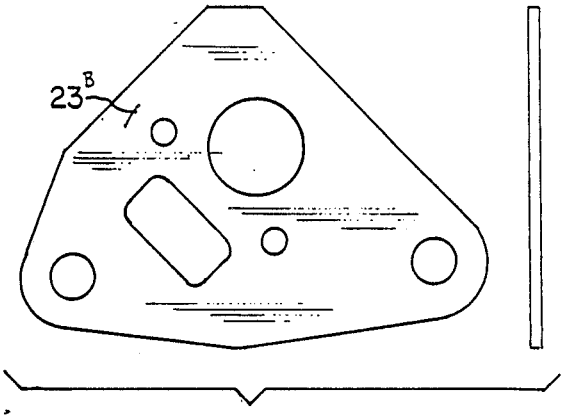
Figure 5C:
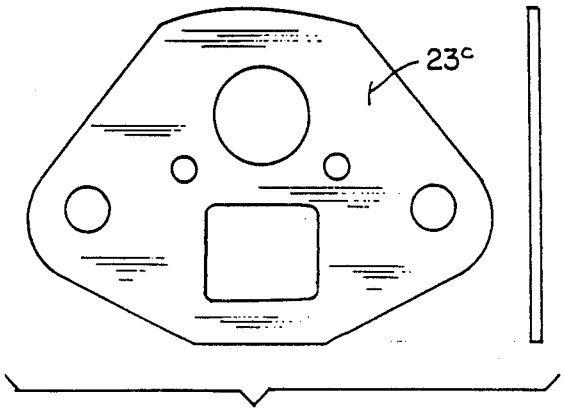
Figure 5D:
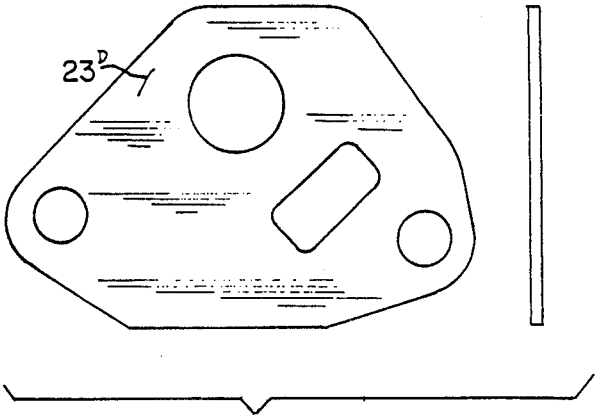

Referring initially to FIGS. 1–6, the present invention contemplates an exhaust gas recirculation valve comprising a base 1, a vacuum motor 3, and a back pressure transducer 5.

The base 1 is of the type commonly known as a butterfly base. The base has protruding flanges 11, which extend out beyond the vacuum motor 3 (as shown particularly in FIG. 3) so that bolt holes 13 are visible and accessible, making attachment of the base to an engine's intake manifold 12 easier. The bolt holes are slightly elongated so that the base may fit on manifolds of different makes of vehicle.

The base 1 further includes a "U" shaped fluid pathway 15 having an entrance 17 and an exit 19, both on the bottom of the base. A cavity 21 is formed around the exit 19, so that base 1 will fit on the manifold of several different makes and models of vehicles. Therefore, a specific base is not needed for each type of vehicle. To enable the base 1 to fit properly on the manifold 12, model specific gaskets 23A, 23B, 23C, and 23D are provided, as shown in FIG. 5. The appropriate gasket 23 is placed between the base 1 and the intake manifold 12.

On one side of the base 1, a hole 25 is bored through the base so that it communicates with the entrance 17 to the pathway 15. A pressure tube 27 is staked into the hole 25 so that it is secure, air-tight, and pivotal. On the opposite side of the base is a threaded blind bore into which a thermal control switch (not shown) may be inserted.

The vacuum motor 3 includes a diaphragm 30 clamped between an upper cup 32 and a lower casing 34 to form a canister 36. The diaphragm 30 and upper cup 32 form a vacuum chamber 38. The canister 36 is secured to a base plate 31. The vacuum motor-base plate assembly is then attached to the base 1 after a gasket 33 has been placed therebetween. The vacuum motor operates by using the vacuum created by the vehicle's carburetor. The vacuum is harnessed by connecting the carburetor through the back pressure transducer 5 (as described hereinafter) to the vacuum chamber 38 via a vacuum tube 35. The vacuum tube 35 is attached to a port 37 protruding from the center of the top of the vacuum motor.

The vacuum motor 3 has a stem 39 with a disk valve 41 rotatably mounted at its lower end. The upper end of the stem 39 is attached to the diaphragm 30, and the disk valve 41 is inserted into the base to close the entrance 17 of the pathway 15. Thus exhaust gas can enter the manifold only when the valve 41 is open. The disk 41 rotates when it is open, so as to retard the buildup of carbon thereon and to extend the life of the valve.

The back pressure transducer 5 is spliced into the vacuum line 35 between the vacuum motor 3 and the carburetor using a "T" nozzle 55. The transducer is connected to the pressure tube 27 via a flexible hose 53 between the pressure tube 27 and a stem 51 protruding from the bottom thereof. The hose 53, like the vacuum tube 35, is preferably made from flexible material, giving the EGR valve more flexibility and making it easier to install.

The transducer 5 comprises a diaphragm valve having a top cup 57 with bleed holes 59 and an annular air filter 67, a bottom cup 61, and a diaphragm 63 between the two cups. Internal spring 65 is placed between the diaphragm 63 and the top cup 57 to hold the diaphragm down, away from the lower end 69 of the stem 60 of the T-nozzle 55. Thus, the transducer is initially opened, and the vacuum created by the carburetor pulls air through the bleed holes 59 and air filter 67 into the top cup 57 and into the vacuum tube 35. Thus no vacuum exists to open the valve 41 of the vacuum motor 3 until the nozzle's stem 69 is closed. When the vehicle is in operation, exhaust enters the transducer 5 through the bottom cup by way of the stem 51. Pressure builds up in the bottom cup 61 and pushes against the diaphragm 63 and the spring 65, until the pressure is sufficient to force the diaphragm 63 against the lower end 69 of the stem 60. The transducer 5 is then closed and permits the vacuum created by the carburetor to be applied to the vacuum motor 3 through the vacuum tube 35.

The stem 60 of the nozzle 55 is threaded and screws into the top cup 57. Thus the distance between the bottom of the stem and the diaphragm can be altered by rotating the nozzle 55, thereby changing the pressure necessary to close off the stem 60 and to open the valve 41. Because different makes and models of vehicles supply different pressures to the exhaust manifold, this allows the same transducer to be used on many different makes and models of vehicles. Preferably, once the nozzle 55 has been rotated to the correct spacing from the diaphragm 63, it is locked in place, as by upsetting the threads on the stem 60.

Referring now to FIGS. 7–9, a second illustrative embodiment of the present invention is a ported vacuum EGR valve on a base 101 of a type commonly known as a boat. The boat base is the same as the butterfly base in all respects except that its shape is altered and the cavity 121 surrounding the pathway's exit 119 is altered. These alterations are necessary so that all vehicles can be fitted with EGR valves, since most vehicles use either a boat base or a butterfly base. Because the embodiment of FIGS. 7–9 is a ported vacuum EGR valve without a transducer, there is no hole similar to hole 25 for a pressure tube.

Model-specific gaskets, like those of FIG. 5 are provided for the base 101.

The vacuum motor 103 of the second embodiment is the same as the vacuum motor 3 of the first embodiment in all respects except that it has two ports 137 and 138 protruding from the top cup 132 of the vacuum motor instead of one. These ports are positioned near the outer periphery of the top and face opposite directions. This ensures that the vacuum tube 135 will not have to be bent more than 90° when attached to the vacuum motor. The vacuum tube 135 is attached to the most convenient port 138 and the other port 137 is capped as at 139 in FIG. 9.

Numerous variations, within the scope of the appended claims, will be apparent to those skilled in the art in light of the foregoing description and accompanying drawings. Merely by way of example, the pressure tube could be inserted directly into the exhaust manifold, rather than into the base. Although a longer rotatable pressure tube is preferred, a short fixed tube may be used. This would require the use of more hose when connecting the pressure tube to the base but the desired flexibility would still be present. A transducer may be added to the second embodiment, by boring a hole in the side of the base, which communicates with the entrance thereof. These variations are merely illustrative.

We claim:

1. An exhaust gas recirculation valve having a universal base, said base having a surface with an entrance and an exit adapted to communicate with openings in the intake manifold of an internal combustion engine of a vehicle, an enlarged cavity in said surface around at least one of said entrance and said exit, and a model-specific gasket, sized and shaped to fit between said surface and said intake manifold, said gasket including openings aligned with the openings in the manifold; said base having a vacuum motor mounted thereon, wherein said vacuum motor has two opposite facing ports fixedly mounted on the top thereof so as to make connection of a vacuum hose to the valve easier and wherein said hose is connected to one port, the other port being capped.

2. An exhaust gas recirculation valve comprising a vacuum motor having a canister defining a vacuum chamber, said canister having a plurality of ports extending from the top thereof, said ports facing different directions, each of said ports being connectible to a vacuum tube, and means for capping all of the ports not connected to the vacuum tube.

3. The diaphragm valve of claim 2, wherein exactly two said ports provided on said canister, said ports facing opposite directions, whereby when a vacuum tube is connected to one of said ports, said vacuum tube will not be bent more than 90°.

4. An exhaust gas recirculation valve having a universal base, said base having a surface with an entrance and an exit adapted to communicate with openings in the intake manifold of an internal combustion engine of a vehicle, an enlarged cavity in said surface around at least one of said entrance and said exit, and a plurality of model-specific gaskets for individual use with said valve, each of said gaskets being sized and shaped to fit between said surface and said intake manifold, each said gasket including openings aligned with the openings in the manifold, wherein said gaskets have differently placed openings therein, and at least some of said plurality of model-specific gaskets cover a part of said cavity in said surface of said base.

5. The exhaust gas recirculation valve of claim 4, wherein said base has a fluid pathway through which exhaust gases flow between said entrance and said exit, said base having a vacuum motor mounted thereon to control the flow of exhaust gases within the engine, said base further having a hole extending therethrough into communication with said entrance.

6. The exhaust gas recirculation valve of claim 5, wherein a remote back pressure transducer is pivotally mounted to said base by passing a pressure tube through said hole.

7. The exhaust gas recirculation valve of claim 6, wherein said remote back pressure transducer comprises calibration means for calibrating the pressure necessary to open said diaphragm valve.

8. The remote back pressure transducer of claim 7, wherein said calibration means comprises a "T" nozzle which is threadedly mounted to the top of said transducer and a diaphragm within said transducer, whereby the distance between said diaphragm and the bottom of said "T" nozzle may be increased or decreased such that the pressure necessary to close said "T" nozzle is altered.

* * * * *